US011338949B2

(12) United States Patent
Okuda et al.

(10) Patent No.: US 11,338,949 B2
(45) Date of Patent: May 24, 2022

(54) SHEET STORING APPARATUS

(71) Applicant: GLORY LTD., Hyogo (JP)

(72) Inventors: Akira Okuda, Hyogo (JP); Yoichi Takemura, Hyogo (JP); Kazuaki Nishimura, Hyogo (JP)

(73) Assignee: GLORY LTD., Hyogo (JP)

( * ) Notice: Subject to any disclaimer, the term of this patent is extended or adjusted under 35 U.S.C. 154(b) by 204 days.

(21) Appl. No.: 16/260,456

(22) Filed: Jan. 29, 2019

(65) Prior Publication Data

US 2019/0233147 A1 Aug. 1, 2019

(30) Foreign Application Priority Data

Jan. 31, 2018 (JP) ..... JP2018-014845

(51) Int. Cl.
*B65B 5/06* (2006.01)
*B65B 5/10* (2006.01)
(Continued)

(52) U.S. Cl.
CPC ..... *B65B 25/14* (2013.01); *B65B 5/067* (2013.01); *B65B 5/106* (2013.01); *B65B 35/50* (2013.01);
(Continued)

(58) Field of Classification Search
CPC ..... B65B 25/14; B65B 35/50; B65B 67/1222; B65H 31/34; B65H 2301/541; B65H 2701/1912; G07D 11/009
(Continued)

(56) References Cited

U.S. PATENT DOCUMENTS 4,027,580 A * 6/1977 Sundin ..... B65H 29/00 414/790.7
4,069,925 A * 1/1978 Ahokas ..... B65G 57/11 198/464.4
(Continued)

FOREIGN PATENT DOCUMENTS

EP 2736025 A1 * 5/2014 ..... B65B 67/1227
EP 2736025 A1 5/2014
(Continued)

OTHER PUBLICATIONS

European Search Report, European Patent Office, Application No. 19154076.4, dated Jul. 2, 2019, 10 pages.

*Primary Examiner* — Thanh K Truong
*Assistant Examiner* — Patrick B Fry
(74) *Attorney, Agent, or Firm* — Greenblum & Bernstein, P. L.C.

(57) ABSTRACT

A sheet storing apparatus, includes: an inlet section configured to take in sheets from outside of the apparatus into the apparatus; a storing unit configured to mount a storage bag in a storing area of the storage unit; and a recognition unit configured to count the number of sheets to be stored in the storage bag mounted in the storing area of the storing unit, in which the storing unit includes: a holding section configured to hold the storage bag mounted in the storing area of the storing unit; a support section configured to support the sheets stored in the storage bag from below via the storage bag; a drive section configured to move up and down the support section between an initial position and a final position; and a control section configured to control the drive section, based on the number of sheets counted by the recognition unit.

9 Claims, 15 Drawing Sheets

(51) Int. Cl.

| | |
|---|---|
| ***B65B 25/14*** | (2006.01) |
| ***B65B 35/50*** | (2006.01) |
| ***B65B 51/10*** | (2006.01) |
| ***B65B 51/14*** | (2006.01) |
| ***B65B 63/02*** | (2006.01) |
| ***B65B 67/12*** | (2006.01) |
| ***B65H 29/46*** | (2006.01) |
| ***B65H 31/02*** | (2006.01) |
| ***B65H 31/30*** | (2006.01) |
| ***B65H 31/34*** | (2006.01) |
| ***G07D 11/00*** | (2019.01) |
| ***G07D 11/16*** | (2019.01) |
| ***G07D 11/12*** | (2019.01) |

(52) U.S. Cl.
CPC ..... *B65B 51/10* (2013.01); *B65B 51/146* (2013.01); *B65B 63/02* (2013.01); *B65H 29/46* (2013.01); *B65H 31/02* (2013.01); *B65H 31/3018* (2013.01); *G07D 11/12* (2019.01); *G07D 11/16* (2019.01); *B65H 2301/4212* (2013.01); *B65H 2301/4223* (2013.01); *B65H 2301/422548* (2013.01); *B65H 2301/541* (2013.01); *B65H 2405/311* (2013.01); *B65H 2701/1912* (2013.01)

(58) Field of Classification Search
USPC ..... 53/244, 245
See application file for complete search history.

(56) References Cited

U.S. PATENT DOCUMENTS

| | | | | |
|---|---|---|---|---|
| 5,899,448 | A * | 5/1999 | Hosking | B65H 1/025 271/3.08 |
| 7,556,263 | B2 * | 7/2009 | Kitagawa | B65H 31/06 271/207 |
| 7,877,966 | B2 * | 2/2011 | Knoke | B65B 43/465 53/469 |
| 9,045,309 | B2 * | 6/2015 | Hashimoto | B65H 31/22 |
| 9,754,436 | B1 | 9/2017 | Drasinover | |
| 10,046,873 | B2 * | 8/2018 | Razzaboni | G07D 11/125 |
| 2016/0031574 | A1 * | 2/2016 | Razzaboni | B65B 7/02 53/268 |
| 2018/0029730 | A1 | 2/2018 | Yokoo et al. | |

FOREIGN PATENT DOCUMENTS

| | | | | |
|---|---|---|---|---|
| JP | 2008009709 | A | 1/2008 | |
| KR | 10-1700277 | B1 | 2/2017 | |
| WO | 2016-136517 | A1 | 9/2016 | |
| WO | WO-2016136517 | A1 * | 9/2016 | B65B 7/02 |
| WO | 2018/012128 | A1 | 1/2018 | |

* cited by examiner

SHEET STORING APPARATUS

CROSS REFERENCE TO RELATED APPLICATIONS

This application is entitled to and claims the benefit of Japanese Patent Application No. 2018-014845, filed on Jan. 31, 2018, the disclosure of which including the specification, drawings and abstract is incorporated herein by reference in its entirety.

TECHNICAL FIELD

The present invention relates to a sheet storing apparatus.

BACKGROUND ART

PTL 1 discloses a banknote storing mechanism that stores banknotes in a storage bag, such as a pouch, and discloses that a placing section on which at least a part of the storage bag is placed is movable up and down. PTL 1 further discloses that the storage bag is sealed to enclose banknotes in the storage bag.

CITATION LIST

Patent Literature

PTL 1
WO 2016/136517

SUMMARY OF INVENTION

Technical Problem

Unfortunately, there is a possibility that if the number of banknotes stored in the storage bag is small when the placing section is moved up and down, the banknotes stacked so that their print surfaces will be oriented upward collapse in the storage bag. In case the banknotes collapse in the storage bag, there is a possibility that failures, such as stacking failure of banknotes in the storage bag, and sealing failure at the storage bag, occur.

Accordingly, an object of the present invention is to provide a technique of appropriately storing banknotes in the storage bag even when the number of banknotes to be stored in the storage bag is small.

Solution to Problem

In order to achieve the above object, a sheet storing apparatus, comprising: an inlet section configured to take in sheets from outside of the apparatus into the apparatus; a storing unit configured to mount a storage bag in a storing area of the storage unit, the storage bag being for storing the sheets taken in into the apparatus; and a recognition unit configured to count the number of sheets to be stored in the storage bag mounted in the storing area of the storing unit, wherein the storing unit includes: a holding section configured to hold the storage bag mounted in the storing area of the storing unit; a support section configured to support the sheets stored in the storage bag from below via the storage bag; a drive section configured to move up and down the support section between an initial position and a final position; and a control section configured to control the drive section, based on the number of sheets counted by the recognition unit.

Advantageous Effects of Invention

The present invention can appropriately store banknotes in the storage bag even when the number of banknotes to be stored in the storage bag is small.

DESCRIPTION OF EMBODIMENTS

Embodiments of the present invention are hereinafter described with reference to the accompanying drawings. The following description illustrates an example of an application of a sheet storing apparatus in a banknote storing apparatus.

Figure 1:
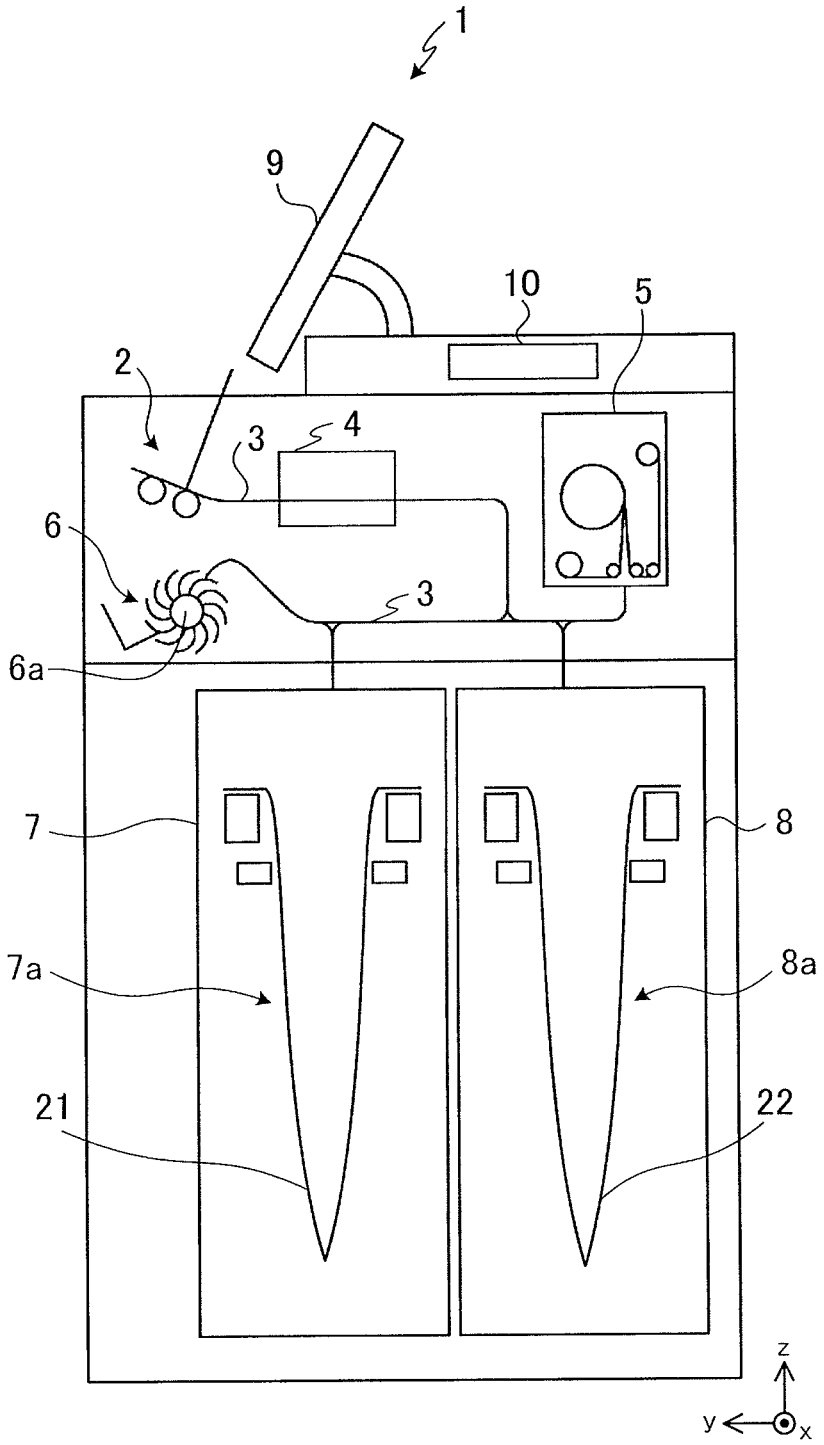
FIG. 1 is a schematic configuration diagram of a banknote storing apparatus.

FIG. 1 is a schematic configuration diagram of a banknote storing apparatus 1. As shown in FIG. 1, the banknote storing apparatus 1 includes an inlet section 2, a transport system 3, a recognition unit 4, a storing and feeding unit 5, a dispensing section 6, storing units 7 and 8, an operation/display section 9, and a control section 10. FIG. 1 also shows storage bags 21 and 22 attached to the respective storing units 7 and 8 and mounted in respective storing areas 7*a* and 8*a* of the storing units 7 and 8. For example, the banknote storing apparatus 1 shown in FIG. 1 is installed in a front area or a back office area of a store, such as a supermarket, or is installed in a lobby of a bank, in a bank or the like, and performs various processes, such as depositing and dispensing processes. Hereinafter, an x-, y- and z-axes orthogonal coordinate system shown in FIG. 1 is defined for the banknote storing apparatus 1.

A user put banknotes in the inlet section 2. The inlet section 2 includes a feeding mechanism section that feeds out the put-in banknotes one by one to the transport system 3.

The recognition unit 4 is provided on the transport system 3, and is disposed downstream of the inlet section 2 along the transport system 3, and is disposed upstream of the storing and feeding unit 5, the dispensing section 6 and the storing units 7 and 8 along the transport system 3. The recognition unit 4 includes various sensors (not shown), recognizes the denomination, authenticity, face/back, fitness, new/old and the like of banknotes being transported through the transport system 3, and counts the number of banknotes being transported through the transport system 3. According to the recognition result of the recognition unit 4 or the user's operation, the banknotes being transported through the transport system 3 are transported to any of the storing and feeding unit 5, the dispensing section 6, and the storage bags 21 and 22 positioned in the respective storing units 7 and 8. Counters (not shown) are provided along the transport system 3 adjacent to the respective storing units 7 and 8. These counters respectively count the number of banknotes being transported to the storage bags 21 and 22 provided in the storing areas 7*a* and 8*a*. It is hereinafter assumed that the recognition unit 4 also includes the counters.

The storing and feeding unit 5 includes what is called a winding banknote storing and feeding mechanism. The storing and feeding unit 5 temporarily stores the banknotes transported through the transport system 3, and feeds out the temporarily stored banknotes to the transport system 3.

The banknotes transported through the transport system 3 and recognized and counted by the recognition unit 4 are stacked in the dispensing section 6. The dispensing section 6 causes a rotating stacking wheel to align and stack the banknotes having been transported through the transport system 3 and recognized and counted by the recognition unit 4. The user can take the banknotes stacked in the dispensing section 6, from the front of the banknote storing apparatus 1.

The storing unit 7 is provided with holding sections 34*a* and 34*b*. The holding sections 34*a* and 34*b* hold the storage bag 21, thus allowing the storage bag 21 to be mounted in the storing area 7*a* of the storing unit 7. The storage bag 21 is mounted in the storing area 7*a* of the storing unit 7 in a state where the opening portion of the storage bag 21 is opened. The banknotes being transported through the transport system 3 are counted by the recognition unit 4 and then stored in the storage bag 21 with its opening portion of the storage bag 21 being opened.

The storing unit 8 is provided with holding sections 34*a* and 34*b*. The storage bag 22 is held by the holding sections 34*a* and 34*b*, thus allowing the storage bag 22 to be mounted in the storing area 8*a* of the unit 8. The storage bag 22 is mounted in the storing area 8*a* of the storing unit 8 in a state where the opening portion of the storage bag 21 is opened. The banknotes being transported through the transport system 3 are counted by the recognition unit 4 and then stored in the storage bag 22 with its opening portion of the storage bag 21 being opened.

The operation/display section 9 is, for example, a touch panel. The operation/display section 9 displays various pieces of information pertaining to the banknote storing apparatus 1. For example, the operation/display section 9 displays information that pertains to the process situation of the banknote depositing and dispensing processes, the inventory amount of banknotes stored in the storage bags 21 and 22 and the like. The operation/display section 9 accepts a user operation, and transmits information on the accepted user operation to the control section 10.

The control section 10 controls the operation of the entire apparatus of the banknote storing apparatus 1. The control section 10 is described later in detail.

It is noted that the number of storing units is not limited to two. The number of storing units may be one, or three or more.

Figure 2:
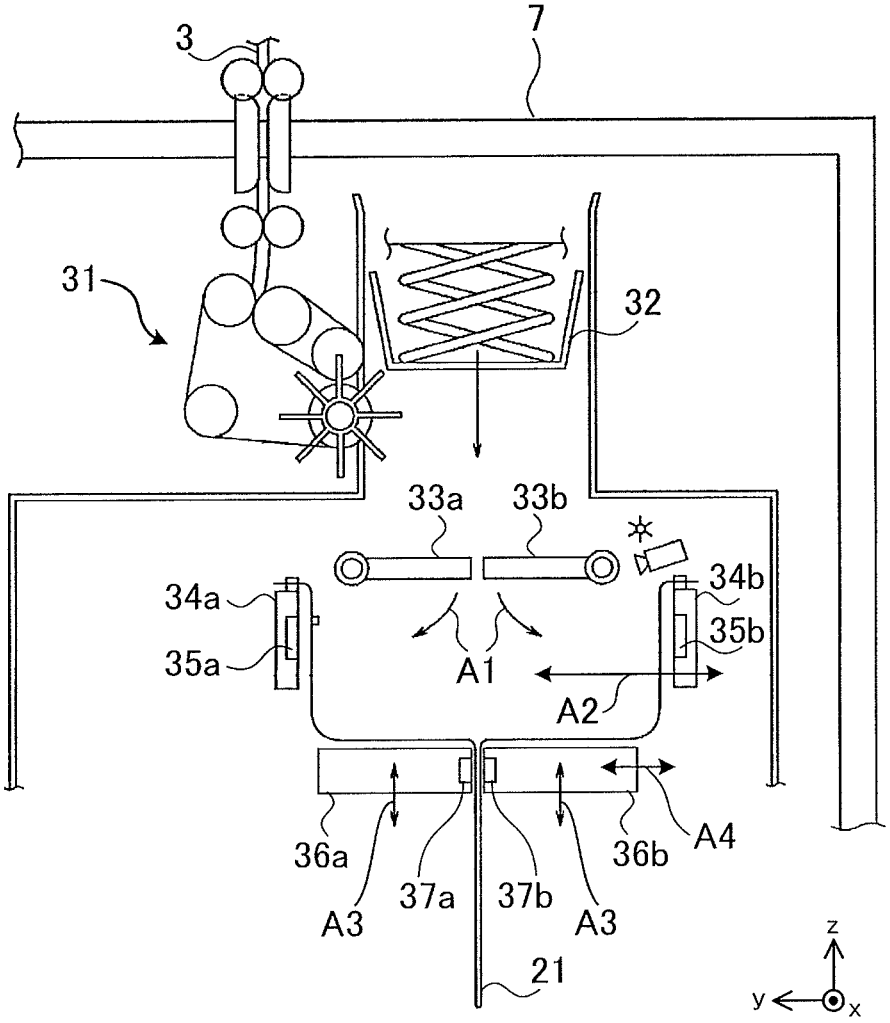
FIG. 2 shows a configuration example of a banknote storing mechanism in a storing unit.

FIG. 2 shows a configuration example of the banknote storing mechanism in the storing unit 7. In FIG. 2, like elements as those in FIG. 1 are assigned the same symbols. As shown in FIG. 2, the storing unit 7 includes a feeding section 31, a pusher (pressing section) 32, temporary storage plates 33*a* and 33*b*, holding sections 34*a* and 34*b*, heating sections 35*a*, 35*b*, 37*a* and 37*b*, and stages (support sections) 36*a* and 36*b*.

The feeding section 31 is connected to the transport system 3. The feeding section 31 feeds out, one by one, the banknotes transported from the transport system 3, to a temporary storage space that is on the temporary storage plates 33*a* and 33*b* and is for temporarily storing banknotes.

The pusher 32 is coupled to a pantograph that is an expansion and contraction mechanism that expands and contracts in the vertical direction by a drive section (not shown), such as a motor. The pusher 32 is moved up and down by the pantograph expanding and contracting in the vertical direction. FIG. 2 shows the pusher 32 disposed uppermost. The pusher 32 disposed uppermost is disposed upper than an outlet through which banknotes are fed out from the feeding section 31. The pusher 32 moves, for example, from the state shown in FIG. 2 toward the inside of the storage bag 21.

The temporary storage plates 33*a* and 33*b* are provided lower than the feeding section 31 so as to face each other in the horizontal direction. The temporary storage plate 33*a* and the temporary storage plate 33*b* are turned around the respective axes by drive sections (not shown), such as motors, and are opened and closed as with doors. For example, as indicated by arrows A1 in FIG. 2, the temporary storage plate 33*a* and the temporary storage plate 33*b* are turned in the downward direction, and an opening is formed between the temporary storage plate 33*a* and the temporary storage plate 33*b*.

The temporary storage plates 33*a* and 33*b* are plate-shaped members. While the temporary storage plates 33*a* and 33*b* are closed (in the state shown in FIG. 2), the banknotes fed out from the feeding section 31 are temporarily stored in the temporary storage space. That is, the banknotes fed out from the feeding section 31 are stacked on the temporary storage plates 33*a* and 33*b* in the closed state so that their print surfaces will be oriented in the vertical direction. The temporary storage plates 33*a* and 33*b* are turned around the respective fixed axes in the direction of the arrows A1 in FIG. 2 to form the opening between the temporary storage plate 33*a* and the temporary storage plate 33*b*, which let the banknotes temporarily stored in the temporary storage space on the temporary storage plates 33*a* and 33*b* fall into the storage bag 21.

When the banknotes fall into the storage bag 21, the pusher 32 moves downward. For example, the pusher 32 moves downward by a predetermined distance. Accordingly, the banknotes having fallen into the storage bag 21 are stacked between the pusher 32 and the stages 36*a* and 36*b*, thus being pressed by the pusher 32 in the storage bag 21.

The holding sections 34*a* and 34*b* are provided lower than the temporary storage plates 33*a* and 33*b* so as to be opposite to each other in the horizontal direction. An upper end portion of the storage bag 21 is attached onto the upper parts of the respective holding sections 34*a* and 34*b*.

The holding section 34*b* moves toward or apart from the holding section 34*a* by drive sections (not shown), such as motors, as indicated by arrows A2 in FIG. 2. The movement of the holding section 34*b* toward the holding section 34*a* closes the upper part of the storage bag 21. It is noted that the holding section 34*a* may move toward the holding section 34*b*. Further, both the holding sections 34*a* and 34*b* may move toward each other.

The holding sections 34*a* and 34*b* internally include heating sections 35*a* and 35*b*, such as heaters, respectively. When the holding section 34*b* moves toward the holding section 34*a* to close the opening of the storage bag 21, the heating sections 35*a* and 35*b* are controlled by the control section 10 to increase the temperatures.

When the temperatures of the heating sections 35*a* and 35*b* increase, the portion of the storage bag 21 clamped by the holding sections 34*a* and 34*b* is heat-welded. Accordingly, the opening of the storage bag 21 is sealed.

The stages 36*a* and 36*b* are provided lower than the respective holding sections 34*a* and 34*b* so as to be opposite to each other in the horizontal direction. A gap is formed between the stages 36*a* and 36*b*. A part (lower part) of the storage bag 21 suspended at the holding sections 34*a* and 34*b* is inserted through the gap below the stages 36*a* and 36*b*. The stages 36*a* and 36*b* support the banknotes stored in the storage bag 21 from below via the storage bag 21.

The stages 36*a* and 36*b* are moved up and down by drive sections (not shown), such as motors, as indicated by arrows A3 directions in FIG. 2. The stage 36*b* is moved by the drive section (not shown), such as the motor, in the lateral direction so as to reduce and increase the gap with the stage 36*a*, as indicated by an arrow A4 in FIG. 2. It is noted that the stage 36*a* may move toward the stage 36*b*. Further, both the stages 36*a* and 36*b* may move toward each other.

The stages 36*a* and 36*b* internally include heating sections 37*a* and 37*b*, such as heaters, respectively. When the stage 36*b* moves toward the stage 36*a* to close the storage bag 21 inserted through the gap between the stages 36*a* and 36*b*, the temperatures of the heating sections 37*a* and 37*b* are increased by control of the control section 10.

When the temperatures of the heating sections 37*a* and 37*b* increase, the portion of the storage bag 21 clamped by the stages 36*a* and 36*b* is heat-welded. Accordingly, the storage bag 21 is sealed at a portion below the part where the banknotes are stored.

The storing unit 8 has a configuration analogous to that of the storing unit 7. The description thereof is omitted.

Figure 3:
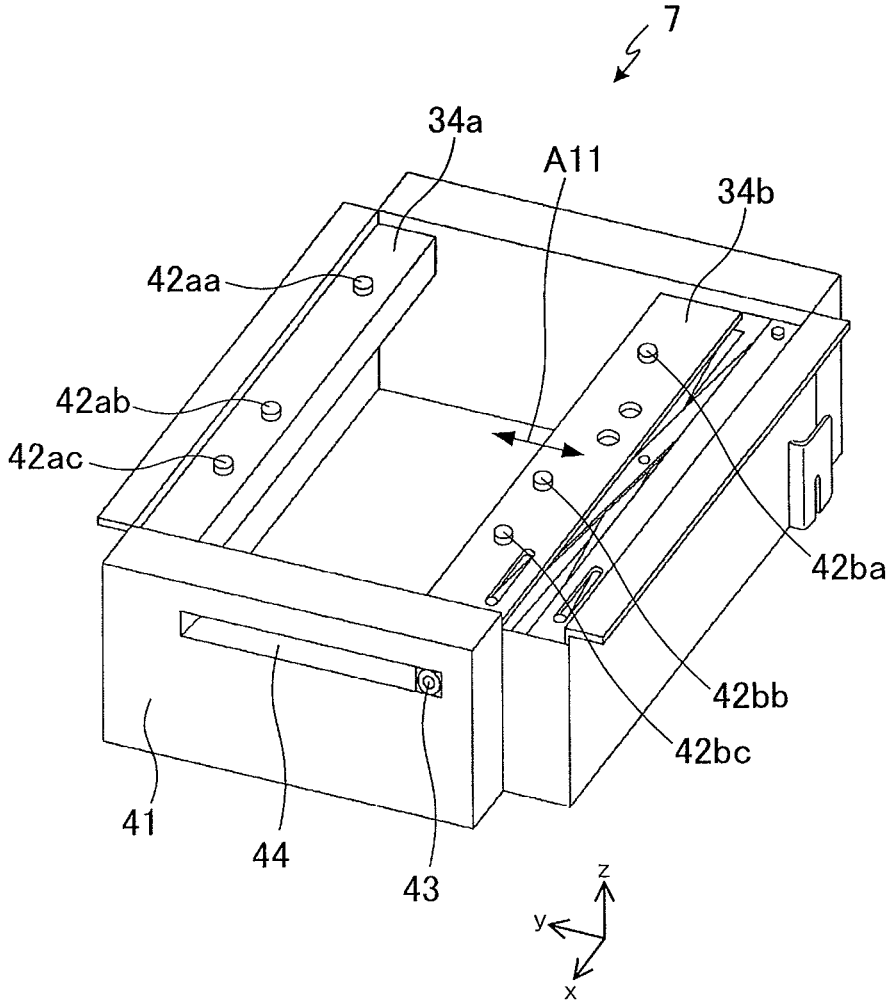
FIG. 3 is a perspective view showing holding sections of the storing unit and therearound.

FIG. 3 is a perspective view showing the holding sections 34*a* and 34*b* of the storing unit 7 and therearound. In FIG. 3, the elements identical to those in FIG. 2 are assigned the same symbols.

The holding sections 34*a* and 34*b* are, for example, rod-like members each having a substantially rectangular cuboid shape, and are provided for a frame 41 having a substantially quadrangular shape so that these sections will be apart to face each other. The holding section 34*b* is coupled to a pantograph, and is movable in the direction of a double-headed arrow A11 shown in FIG. 3 (the direction in which the holding section 34*a* and the holding section 34*b* face each other).

Pins 42*aa* to 42*ac* are provided on the upper surface of the holding section 34*a*. Pins 42*ba* to 42*bc* are provided on the upper surface of the holding section 34*b*. Holes (see holes 52*aa* to 52*ac* and 52*ba* to 52*bc* in FIG. 4) provided for the storage bag 21 are respectively engaged with the pins 42*aa* to 42*ac* and 42*ba* to 42*bc*. The holes provided for the storage bag 21 are thus engaged with the pins 42*aa* to 42*ac* and the pins 42*ba* to 42*bc*, thereby allowing the storage bag 21 to be suspended in the storing unit 7.

A guide pin 43 is provided at an end of the holding section 34*b* in the longitudinal direction. The guide pin 43 is guided in an elongated hole 44 provided for the frame 41. The elongated hole 44 is formed in the frame 41 so that the longitudinal direction of the hole will be parallel in the direction where the holding sections 34*a* and 34*b* face each other. The guide pin 43 is guided in the elongated hole 44, thereby allowing the holding section 34*b* including the guide pin 43 to be movable in the double-headed arrow A11 shown in FIG. 3.

The storing unit 8 has a configuration analogous to that of the storing unit 7. The description thereof is omitted.

Figure 4:
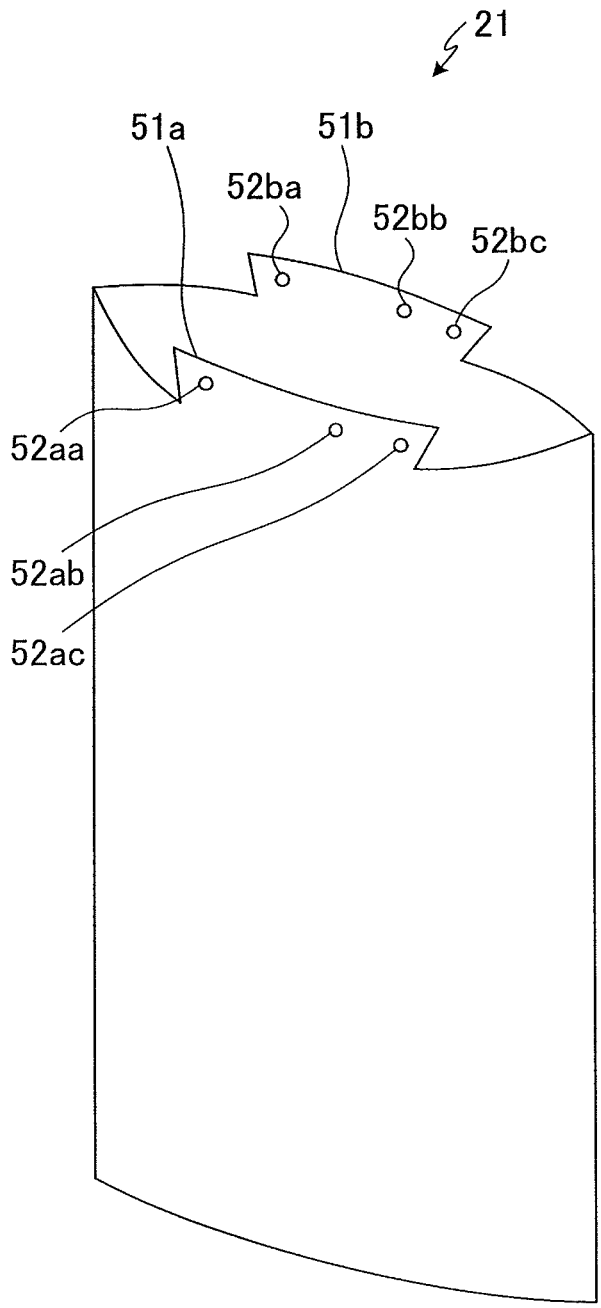
FIG. 4 is a perspective view of a storage bag.

FIG. 4 is a perspective view of the storage bag 21. As shown in FIG. 4, the storage bag 21 has attachment sections 51*a* and 51*b*, and holes 52*aa* to 52*ac* and 52*ba* to 52*bc*.

The storage bag 21 is a bag made of polyethylene as a material. The storage bag 21 has the opening at its upper part. The banknotes transported by the transport system 3 are stored through the opening of the storage bag 21.

The attachment section 51*a* is provided at an end of the storage bag 21 nearer to the opening. The holes 52*aa* to 52*ac* are formed at the attachment section 51*a*. The holes 52*aa* to 52*ac* formed at the attachment section 51*a* are engaged with the pins 42*aa* to 42*ac* on the holding section 34*a* of the storing unit 7 shown in FIG. 3, thereby allowing the attachment section 51*a* to be attached to the holding section 34*a* of the storing unit 7 shown in FIG. 3.

The attachment section 51*b* is provided at an end of the storage bag 21 nearer to the opening and at the position facing the attachment section 51*a*. The holes 52*ba* to 52*bc* are formed at the attachment section 51*b*. The holes 52*ba* to 52*bc* formed at the attachment section 51*b* are engaged with the pins 42*ba* to 42*bc* on the holding section 34*b* of the storing unit 7 shown in FIG. 3, thereby allowing the attachment section 51*b* to be attached to the holding section 34*b* of the storing unit 7 shown in FIG. 3.

The storage bag 22 has a configuration analogous to that of the storage bag 21. Consequently, the description thereof is omitted.

Figure 5:
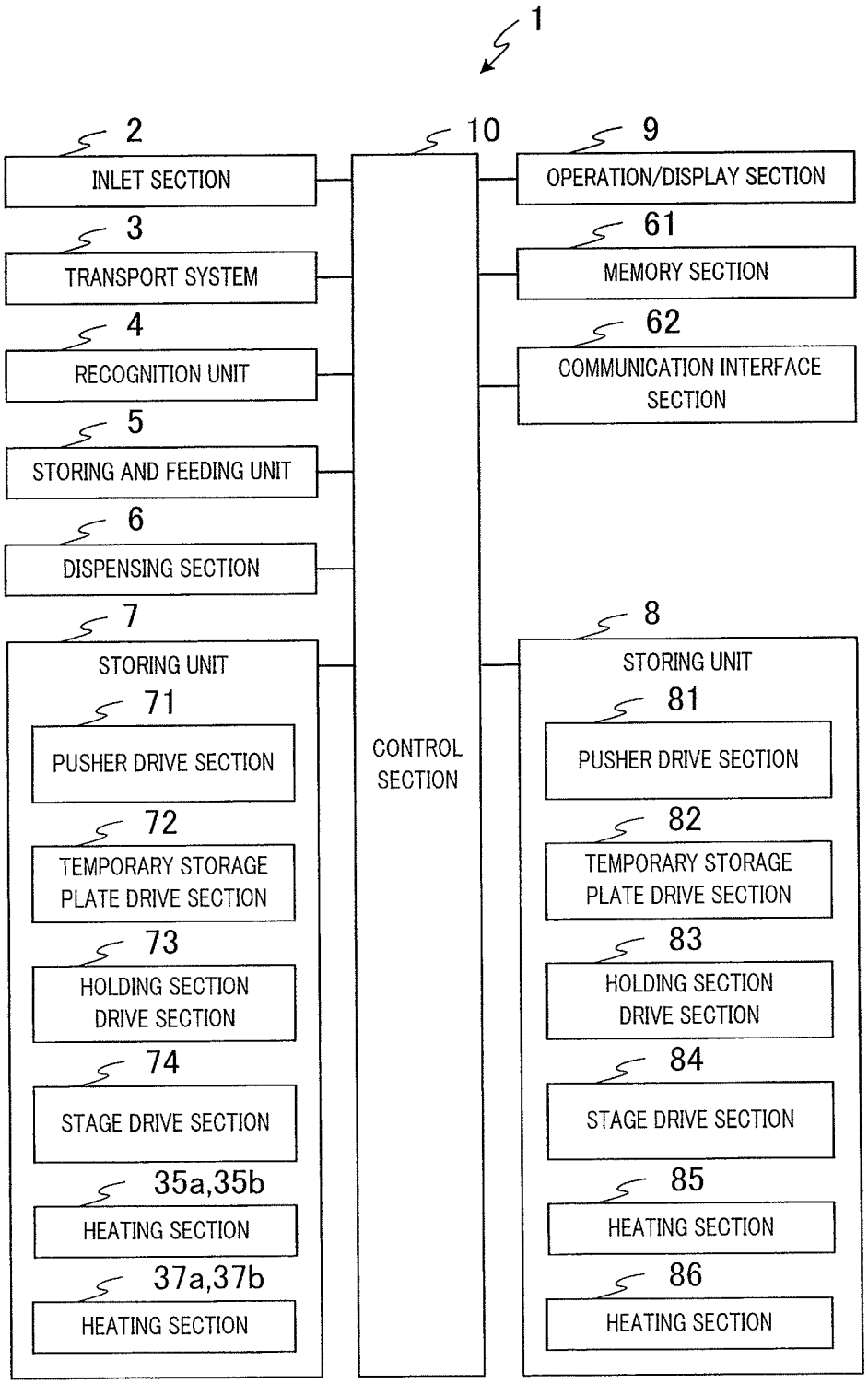
FIG. 5 shows a block configuration example of a control system of the banknote storing apparatus.

FIG. 5 shows a block configuration example of a control system of the banknote storing apparatus 1. In FIG. 5, the elements identical to those in FIGS. 1 and 2 are assigned the same symbols.

As shown in FIG. 5, the inlet section 2, the transport system 3, the recognition unit 4, the storing and feeding unit 5, the dispensing section 6, the storing units 7 and 8 and the operation/display section 9, which have been described with reference to FIG. 1, are connected to the control section 10. Furthermore, a memory section 61 and a communication interface section 62, which are not shown in FIG. 1, are connected to the control section 10. The control section 10 is made up of, for example, a CPU (Central Processing Unit), and controls each of the connected sections.

The memory section 61 stores a program for allowing the control section 10 to operate. Furthermore, the memory section 61 stores data for allowing the control section 10 to perform a calculation process, data for allowing the control section 10 to control each of the connected sections, and the like.

A higher-level apparatus (not shown), such as a server, is connected to the communication interface section 62 via a network, such as the Internet, for example. The control section 10 communicates with the higher-level apparatus via the communication interface section 62. For example, the control section 10 transmits via the communication interface section 62, to the higher-level apparatus, information on the inventory amount of the banknote storing apparatus 1, and the like.

The storing unit 7 includes a pusher drive section (pressing drive section) 71, a temporary storage plate drive section 72, a holding section drive section 73, and a stage drive section (drive section) 74. Furthermore, the storing unit 7 includes the heating sections 35*a* and 35*b* shown in FIG. 2.

The pusher drive section 71 moves up and down the pusher 32 according to the control of the control section 10. The temporary storage plate drive section 72 opens and closes the temporary storage plate 33*a* and the temporary storage plate 33*b* according to the control of the control section 10. The holding section drive section 73 moves the holding section 34*b* in the direction of approaching the holding section 34*a*, and moves the holding section 34*b* in the direction away from the holding section 34*a*, according to the control of the control section 10. The stage drive section 74 moves up and down the stages 36*a* and 36*b* according to the control of the control section 10. Furthermore, the stage drive section 74 moves the stage 36*b* in the direction approaching the stage 36*a*, and moves the stage 36*b* in the direction apart from the stage 36*a*, according to the control of the control section 10. The heating sections 35*a* and 35*b* increase and decrease the temperatures according to the control of the control section 10. The heating sections 37*a* and 37*b* increase and decrease the temperatures according to the control of the control section 10.

The storing unit 8 has a configuration analogous to that of the storing unit 7. The description thereof is omitted.

Figure 6:
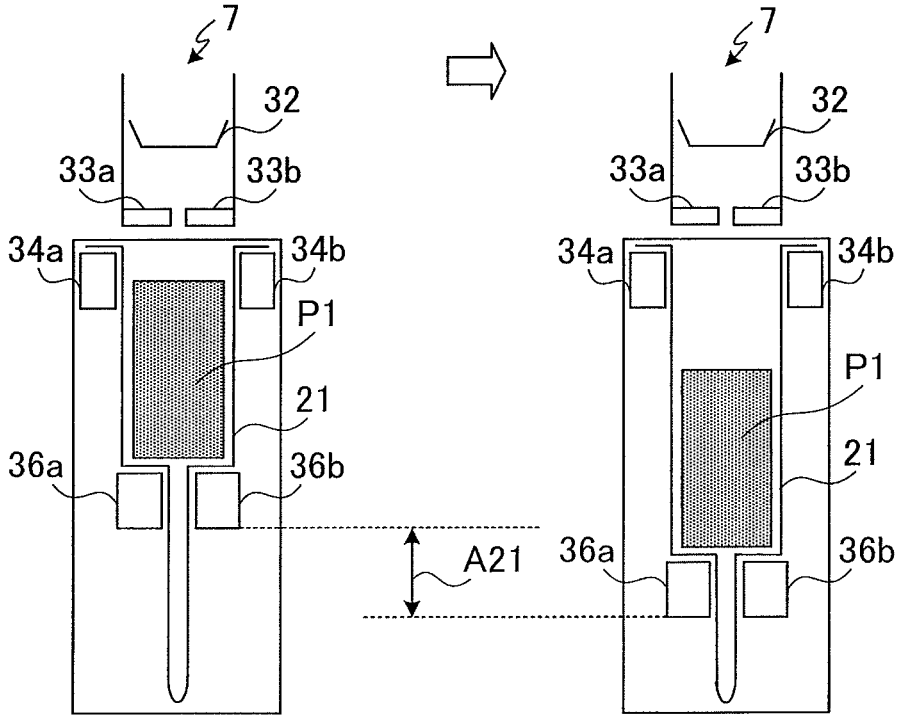
FIG. 6 illustrates an example of an operation before the storage bag in the storing unit is sealed.

FIG. 6 illustrates an example of an operation before the storage bag 21 in the storing unit 7 is sealed. In FIG. 6, the elements identical to those in FIGS. 1 and 2 are assigned the same symbols. In FIG. 6, the shape and the like are more simplified than those in FIG. 2. The operation of the storing unit 8 is analogous to that of the storing unit 7. Consequently, the description of an operation example of the storing unit 8 is omitted.

As shown in a left side diagram of FIG. 6, banknotes P1 are stored in the storage bag 21 positioned in the storing unit 7. This storage bag 21 is collected by the user of the banknote storing apparatus 1 or a banknote collecting service provider, for example. Before the collecting operation, as shown in a right side diagram of FIG. 6, the control section 10 lowers the stages 36*a* and 36*b* from an initial position to a final position located at a predetermined distance from the initial position, and then seals the storage bag 21 at a part below a portion where the banknotes are stored. For example, as shown in an arrow A21 in FIG. 6, the control section 10 lowers the stages 36*a* and 36*b* from the initial position to the final position, and then seals the lower part of the storage bag 21.

The predetermined distance lowering amount of stages 36*a* and 36*b* is, for example, the amount that allows the uppermost part of the banknotes P1 stored in the storage bag 21 to be lowered from that of the holding sections 34*a* and 34*b* to a predetermined position. The reason is as follows.

When the lower part of the storage bag 21 is sealed, the holding section 34*b* moves toward the holding section 34*a*. When the holding section 34*b* moves toward the holding section 34*a*, there is a possibility that the upper part of the banknotes P1 stacked so that the print surfaces will be oriented in the vertical direction, comes into contact with the storage bag 21 and collapses. When the upper part of the banknotes P1 collapses, there is a possibility that a banknote is stacked between the holding sections 34*a* and 34*b* to cause a sealing failure. Accordingly, for example, the stages 36*a* and 36*b* are lowered until the uppermost part of the banknotes P1 stored in the storage bag 21 is set to the predetermined position from holding sections 34*a* and 34*b*.

If the number of banknotes P1 stored in the storage bag 21 is small, there is a possibility that an immediate descent of the stages 36*a* and 36*b* causes the banknotes P1 stacked in the vertical direction to collapse.

Figure 7:
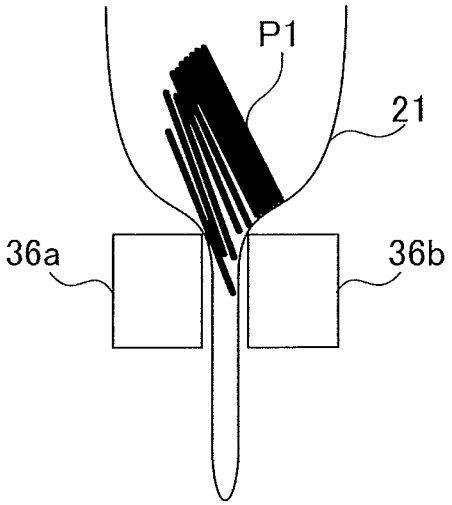
FIG. 7 illustrates collapse of banknotes in a case where the number of banknotes stored in the storage bag is small.

FIG. 7 illustrates collapse of banknotes P1 in a case where the number of banknotes P1 stored in the storage bag 21 is small. FIG. 7 shows the stages 36*a* and 36*b* and a part of the storage bag 21, which are shown in FIG. 6.

If the number of banknotes P1 stored in the storage bag 21 is small, there is a possibility that an immediate descent of the stages 36*a* and 36*b* causes the banknotes P1 to collapse as shown in FIG. 7. For example, if the number of banknotes P1 is small, the weight of the banknotes P1 is small. Consequently, an immediate descent of the stages 36*a* and 36*b* causes the lower part of the storage bag 21 to have a shrunk shape as shown in FIG. 7. Accordingly, there is a possibility that in the state where the banknotes P1 are stacked, so that the print surfaces will be oriented in the vertical direction (see the banknotes P1 in FIG. 6), the banknotes P1 collapse as shown in FIG. 7. In case the banknotes P1 collapse, for example, the banknotes P1 are clamped between the stages 36*a* and 36*b*. As a result, there is a possibility that a sealing failure occurs at a lower part of the storage bag 21.

Consequently, if the number of banknotes P1 stored in the storage bag 21 is small, there is a possibility that the banknotes P1 stacked in the vertical direction collapse. Accordingly, the control section 10 changes how the stages 36*a* and 36*b* are lowered, on the basis of the amount of banknotes P1 stored in the storage bag 21. For example, if the number of banknotes P1 stored in the storage bag 21 is a predetermined number or more, the control section 10 immediately lowers the stages 36*a* and 36*b* from the initial position to the final position without stop, as shown in FIG. 6. On the contrary, if the number of banknotes P1 stored in the storage bag 21 is less than the predetermined number, the control section 10 lowers the stages 36*a* and 36*b* from the initial position to the final position with temporary stops.

If the number of banknotes P1 stored in the storage bag 21 is large, the possibility that even an immediate descent of the stages 36*a* and 36*b* causes the banknotes P1 stacked in the vertical direction to collapse is low. If the number of banknotes P1 is large, the lower part of the storage bag 21 becomes flat along the upper surfaces of the stages 36*a* and 36*b* in the horizontal direction owing to the weight of the banknotes P1.

Figure 8:
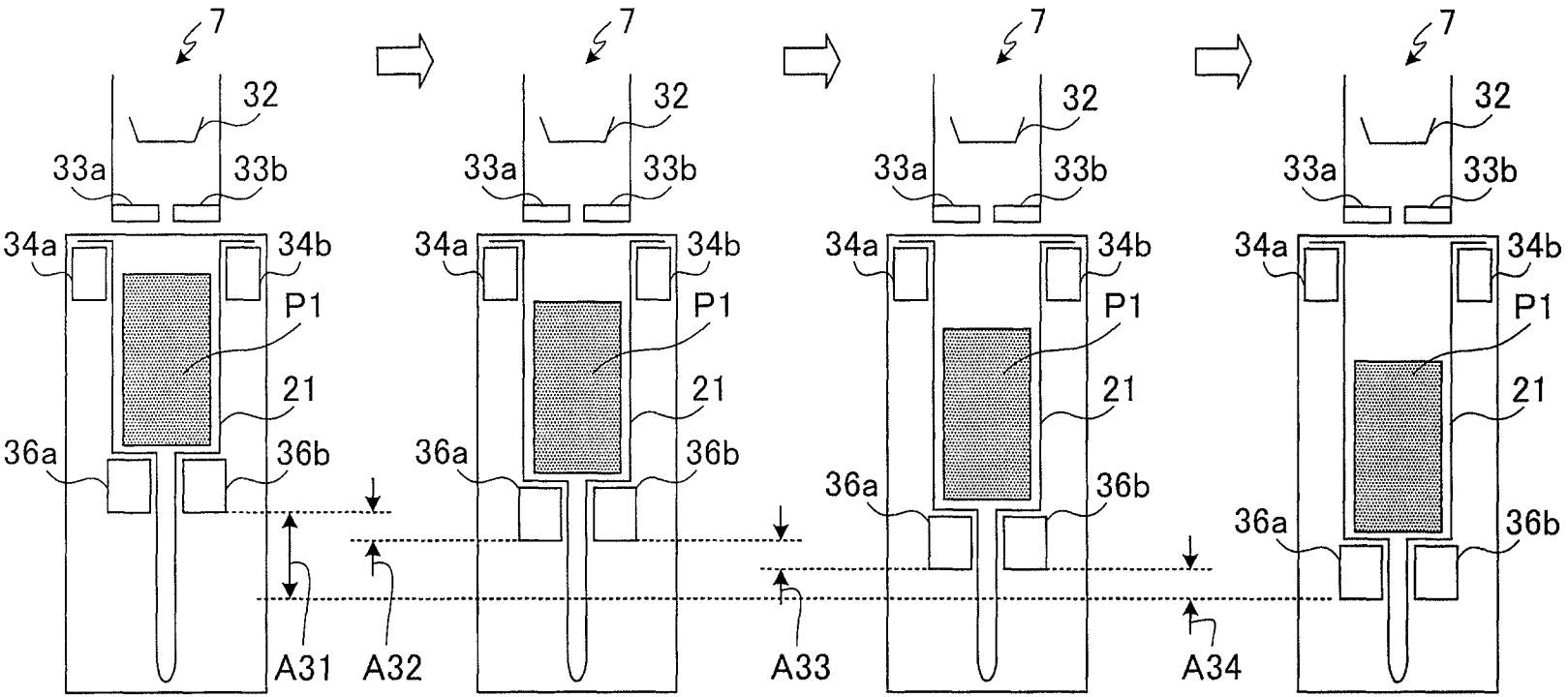
FIG. 8 illustrates an operation principle of the storing unit in the case where the number of banknotes stored in the storage bag is small.

FIG. 8 illustrates an operation principle of the storing unit 7 in the case where the number of banknotes P1 stored in the storage bag 21 is small. In FIG. 8, the elements identical to those in FIG. 6 are assigned the same symbols.

As shown in a left-end diagram of FIG. 8, the banknotes P1 are stored in the storage bag 21 positioned in the storing unit 7. This storage bag 21 is collected by the user of the banknote storing apparatus 1 or a banknote collecting service provider, for example. Before the collecting operation, as shown in a right side diagram of FIG. 8, the control section 10 lowers the stages 36*a* and 36*b* to the final position, and then seals the storage bag 21 at the part below the portion where the banknotes are stored.

The control section 10 stops the stages 36*a* and 36*b* at least once before the stages 36*a* and 36*b* reach to a right end state in FIG. 8 from a left-end state, that is, while the stages 36*a* and 36*b* are lowered from the initial position to the final position. For example, the second diagram from the left end in FIG. 8 shows the situation of a first temporary stop. The third diagram from the left end in FIG. 8 shows the situation of a second temporary stop. That is, the control section 10 stepwisely lowers the stages 36*a* and 36*b* from the initial position to the final position.

An arrow A31 in FIG. 8 indicates a lowering amount (hereinafter, sometimes called a final lowering amount) that is a distance between the initial position and the final position in a case where the stages 36*a* and 36*b* are lowered from the initial position to the final position. As indicated by an arrow A32 in FIG. 8, the control section 10 moves the stages 36*a* and 36*b* in the downward direction by a lowering amount that is less than the final lowering amount of the stages 36*a* and 36*b*, and performs a first temporary stop. Next, as indicated by an arrow A33 in FIG. 8, the control section 10 moves the stages 36*a* and 36*b* in the downward direction by a lowering amount that is less than the final lowering amount of the stages 36*a* and 36*b*, and performs a second temporary stop. As indicated by an arrow A34 in FIG. 8, the control section 10 then moves the stages 36*a* and 36*b* in the downward direction by a lowering amount that is less than the final lowering amount of the stages 36*a* and 36*b*, and stops these stages. In a state of the storing unit 7 shown in the right end in FIG. 8, the control section 10 seals the storage bag 21.

Figure 9:
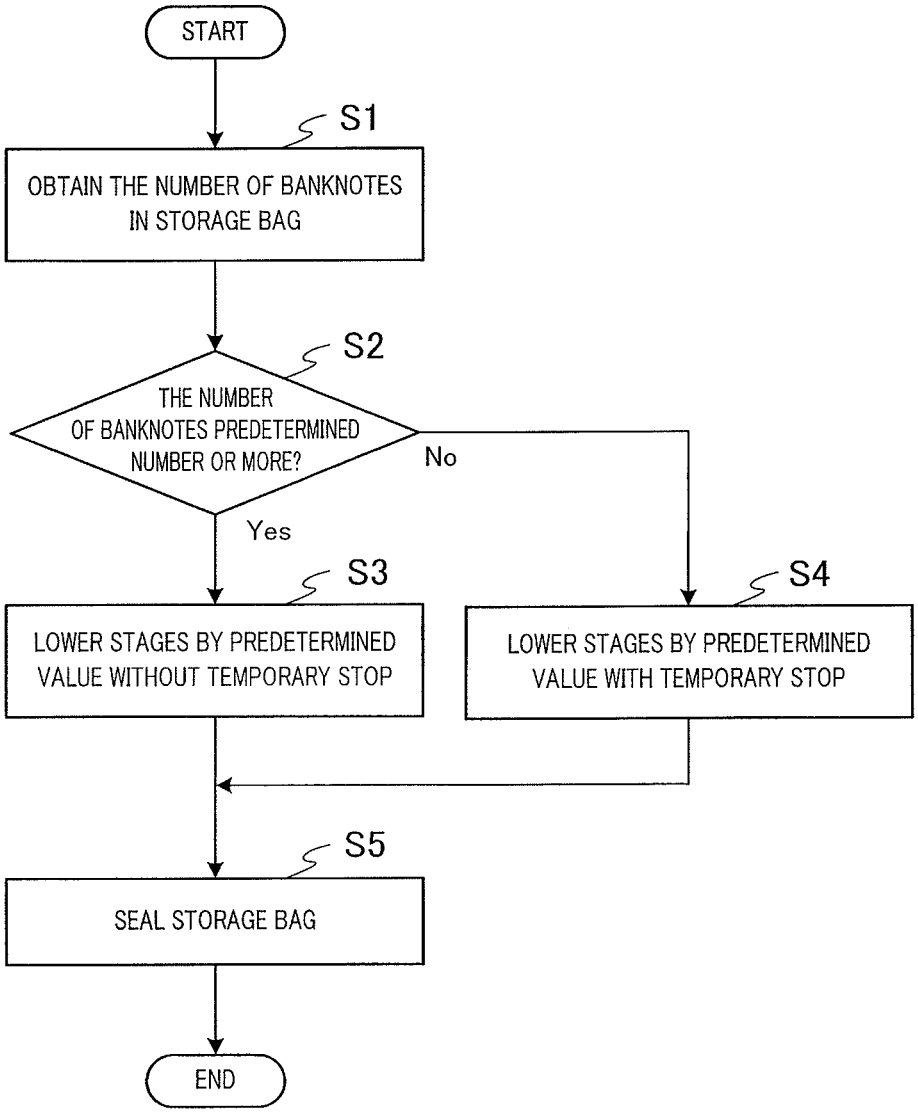
FIG. 9 is a flowchart showing operation control of a control section.

FIG. 9 is a flowchart showing operation control of the control section 10. For example, when a collection button for the storage bags 21 and 22 is pressed through the operation/display section 9, the control section 10 performs the operations of the flow shown in FIG. 9 for the storing units 7 and 8 respectively in which the storage bags 21 and 22 are suspended. Hereinafter, the operation control by the control section 10 for the storing unit 7 is described.

First, the control section 10 obtains the number of banknotes stored in the storage bag 21 (step S1). For example, the control section 10 obtains, from the recognition unit 4, the number of banknotes stored in the storage bag 21 counted by the recognition unit 4 provided on the transport system 3 at the inlet of the storing unit 7.

Next, the control section 10 determines whether or not the number of the banknotes stored in the storage bag 21 is the predetermined number or more (step S2). For example, the control section 10 determines whether or not the number of the banknotes stored in the storage bag 21 is 500 or more.

If the control section 10 determines that the number of banknotes stored in the storage bag 21 is the predetermined number or more ("Yes" in S2), this section lowers the stages 36*a* and 36*b* from the initial position only by the lowering amount to the final position without temporary stop on the way (step S3).

On the contrary, if the control section 10 determines that the number of banknotes stored in the storage bag 21 is not the predetermined number or more ("No" in S2), this section lowers the stages 36*a* and 36*b* from the initial position only by the lowering amount to the final position with temporary stops in process (step S4). The time period for a temporary stop ranges, for example, from several hundred milliseconds to several seconds.

After the control section 10 lowers the stages 36*a* and 36*b* in step S3 or S4, this section performs operation control so as to seal the storage bag 21 at a part lower than the position where the banknotes reside (step S5).

As described above, the number of temporary stops (including zero) of the stages 36*a* and 36*b* is changed on the basis of the number of banknotes stored in the storage bag 21. For example, the number of temporary stops of the stages 36*a* and 36*b* is zero if the number of banknotes stored in the storage bag 21 is 500 or more. That is, the stages 36*a* and 36*b* are immediately lowered from the initial position to the final position without stop. On the contrary, if the number of banknotes stored in the storage bag 21 is less than 500, the number of temporary stops of the stages 36*a* and 36*b* is, for example, two. That is, the stages 36*a* and 36*b* are stepwisely lowered from the initial position to the final position, with stop operations being performed.

Accordingly, if the number of banknotes stored in the storage bag 21 is small, the banknote storing apparatus 1 stepwisely lowers the stages 36*a* and 36*b* to the final position. Consequently, the lower part of the storage bag 21 can be sealed, with the banknotes stacked in the vertical direction being prevented from collapsing. The banknote storing apparatus 1 can prevent the banknotes from being stacked between the stages 36*a* and 36*b*, and suppress a sealing failure in the storage bag 21.

If the number of banknotes stored in the storage bag 21 is large, the banknote storing apparatus 1 immediately lowers the stages 36*a* and 36*b* to the final position. Accordingly, the banknote storing apparatus 1 can reduce the time for sealing the storage bag 21.

The operation of the storing unit 7 in the case where the number of banknotes stored in the storage bag 21 is less than the predetermined number is described in detail.

Figure 10:
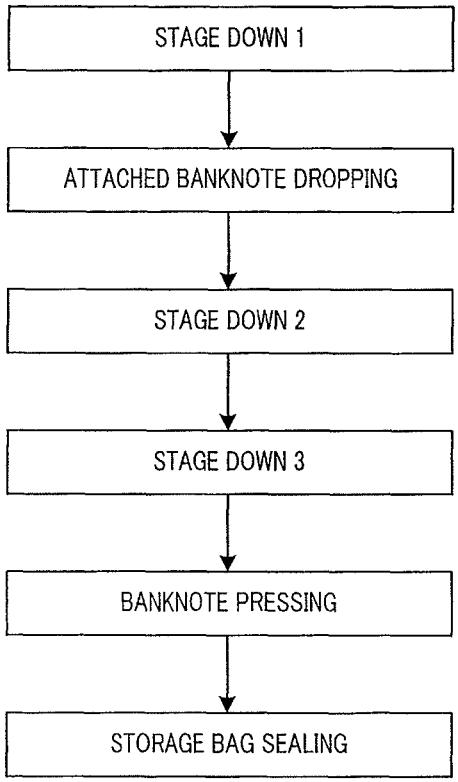
FIG. 10 is an operation flowchart of the storing unit in a case where the number of banknotes stored in the storage bag is less than a predetermined number.

FIG. 10 is an operation flowchart of the storing unit 7 in the case where the number of banknotes stored in the storage bag 21 is less than the predetermined number. The operations of the storing unit 7 are performed under control by the control section 10. For example, as shown in FIG. 10, the operations are classified into six operations that are "stage down 1", "attached banknote dropping", "stage down 2", "stage down 3", "banknote pressing" and "storage bag sealing". The six operations are controlled by the control section 10.

In the "stage down 1", the stages 36*a* and 36*b* are lowered by a lowering amount that is smaller than the final lowering amount of the stages 36*a* and 36*b*, and are temporarily stopped. That is, in "stage down 1", the first stage down is performed.

In the "attached banknote dropping", the temporary storage plate 33*a* and the temporary storage plate 33*b* are opened and closed. This process is performed in order to drop the banknote attached to the temporary storage plates 33*a* and 33*b* by static electricity or the like.

In the "stage down 2", the stages 36*a* and 36*b* are lowered by a lowering amount that is smaller than the final lowering amount of the stages 36*a* and 36*b*, and are temporarily stopped. That is, in "stage down 2", the second stage down is performed.

In the "stage down 3", the stages 36*a* and 36*b* are lowered by a lowering amount that is smaller than the final lowering amount of the stages 36*a* and 36*b*, and are temporarily stopped. That is, in "stage down 3", the third stage down is performed.

In the "banknote pressing", the banknotes stored in the storage bag 21 are pressed by the pusher 32. That is, the banknotes are compressed so as to eliminate the gaps between the banknotes stacked in the vertical direction and to reduce the volume of the banknotes stacked in the vertical direction. In the "banknote pressing", the stage 36*b* moves toward the stage 36*a* to close the gap between the stage 36*a* and stage 36*b*.

In the "storage bag sealing", the lower part of the storage bag 21 is sealed. For example, the storage bag 21 is heat-welded by increasing the temperatures of the heating sections 37*a* and 37*b* internally included in the respective stages 36*a* and 36*b*. The holding section 34*h* moves in the direction toward the holding section 34*a* to close the opening of the storage bag 21. The storage bag 21 is heat-welded by increasing the temperatures of the heating sections 35*a* and 35*b* internally included in the respective holding sections 34*a* and 34*b*.

Figure 11:
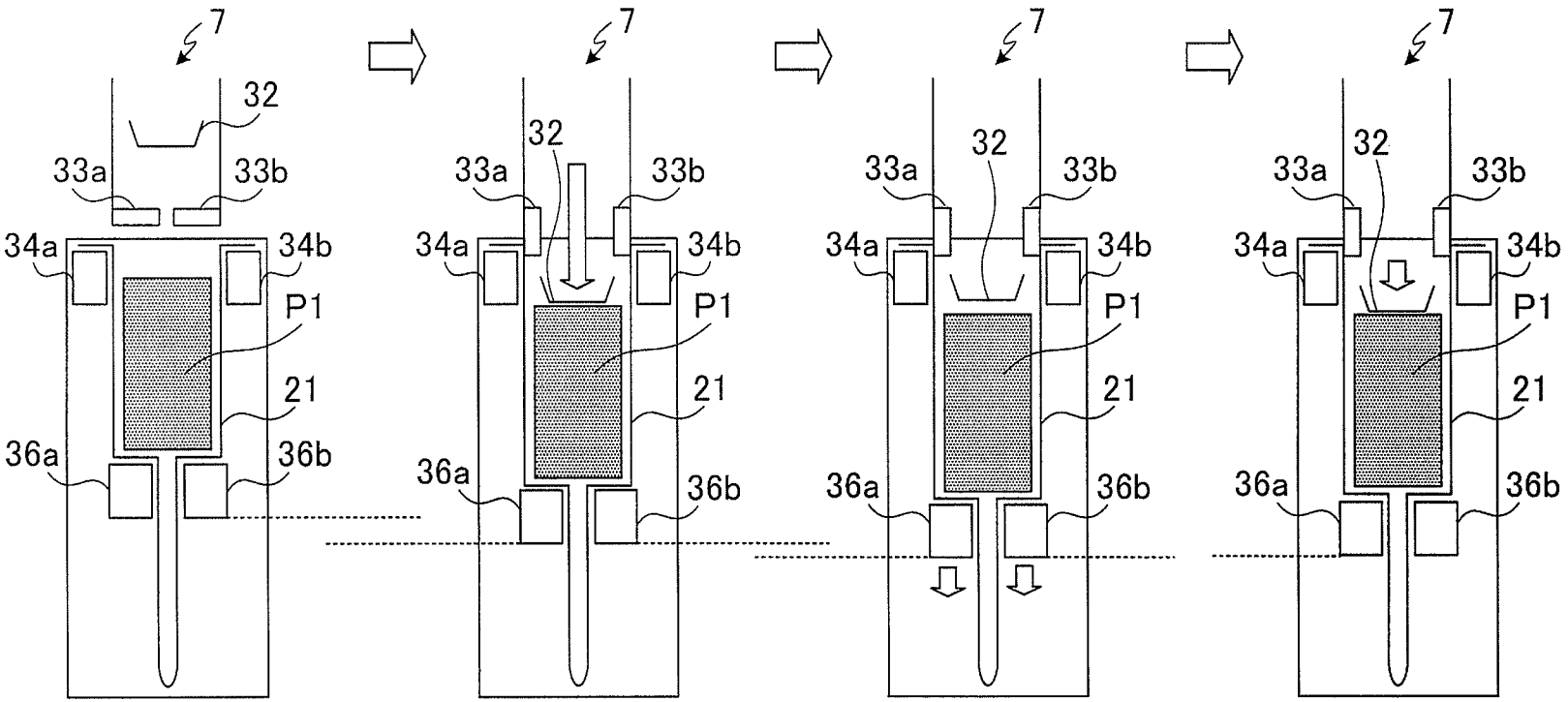
FIG. 11 illustrates detailed operations of "stage down 1"

FIG. 11 illustrates the detailed operations of the "stage down 1". In FIG. 11, the elements identical to those in FIG. 6 are assigned the same symbols.

As shown in a left-end diagram of FIG. 11, the banknotes P1 are stored in the storage bag 21 positioned in the storing unit 7. This storage bag 21 is collected by the user of the banknote storing apparatus 1 or the banknote collecting service provider, for example. A predetermined gap is provided between the stages 36*a* and 36*b* to an extent that allows the stages 36*a* and 36*b* to be moved in the downward direction toward the storage bag 21 and prevents the banknotes P1 stored in the storage bag 21 from falling between the stages 36*a* and 36*b*.

In the "stage down 1", the control section 10 performs the following operation control. First, as shown in the second diagram from the left end in FIG. 11, the temporary storage plate 33*a* and the temporary storage plate 33*b* are opened. The pusher 32 is lowered to the predetermined position. This process is performed so as to lower the uppermost part of the banknotes P1 from the holding sections 34*a* and 34*b* to the predetermined position. The pressing of the banknotes P1 by the pusher 32 also lowers the stages 36*a* and 36*b*.

Next, as shown in the third diagram from the left end in FIG. 11, the stages 36*a* and 36*b* are lowered by a lowering amount that is smaller than the final lowering amount. At this time, the pusher 32 is not raised, with the position of the pusher 32 being maintained, and the stages 36*a* and 36*b* are lowered. For example, the position of the pusher 32 indicated in the second diagram from the left end in FIG. 11 is maintained. As shown in the third diagram from the left end in FIG. 11, the stages 36*a* and 36*b* are lowered. That is, the stages 36*a* and 36*b* and the pusher 32 are alternately lowered.

The lowering amount of the stages 36*a* and 36*b* is, for example, shorter than the length of a short side of the banknote P1. Accordingly, the banknotes at the uppermost part of the banknotes P1 stored in the storage bag 21 are suppressed from being rotated, for example. For example, even when the banknotes at the uppermost part of the banknotes P1 attempt to rotate owing to vibrations or the like caused by the descent of the stages 36*a* and 36*b*, the banknotes collide with the pusher 32, whose position is maintained, and are suppressed from being rotated. The suppression of the rotation of the banknotes, in turn, suppresses the banknotes stacked in the vertical direction from collapsing.

Next, as shown in the right-end diagram in FIG. 11, the pusher 32 is lowered, and the banknotes P1 are pressed by the pusher 32. This process is performed in order to compress the gaps between the banknotes having been widened by the downward movement of the stages 36*a* and 36*b* and to prevent the banknotes from collapsing when the stages 36*a* and 36*b* are subsequently moved in the downward direction.

Figure 12:
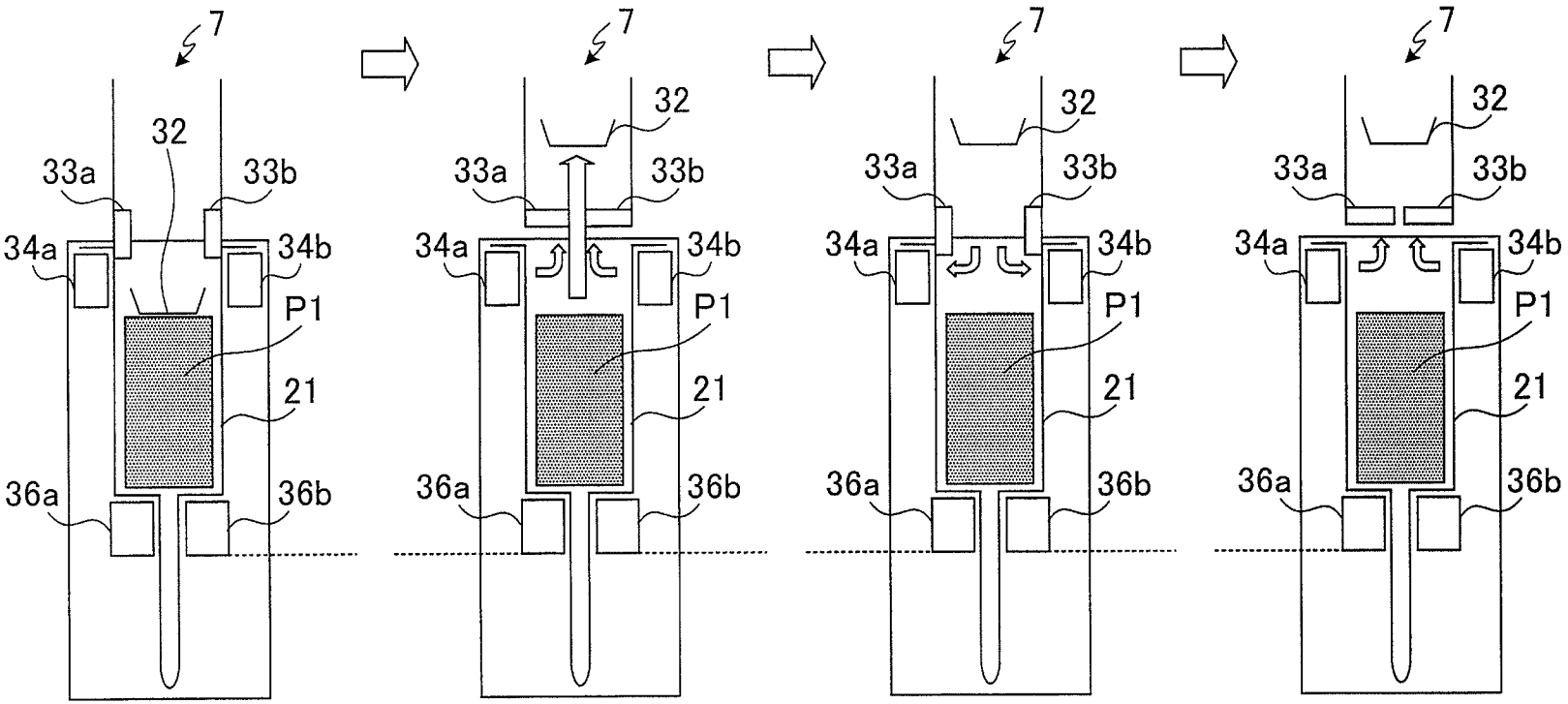
FIG. 12 illustrates detailed operations of "attached banknote dropping"

FIG. 12 illustrates detailed operations of "attached banknote dropping". In FIG. 12, the elements identical to those in FIG. 6 are assigned the same symbols. The left-end diagram in FIG. 12 shows the final state of the storing unit 7 in the "stage down 1" shown in FIG. 11 (the storing unit 7 in the right-end diagram in FIG. 11).

In the "attached banknote dropping", first, the pusher 32 is moved to the uppermost part as shown in the second diagram from the left end in FIG. 12. The temporary storage plates 33*a* and 33*b* are then closed.

Next, as shown in the third diagram from the left end in FIG. 12, the temporary storage plates 33*a* and 33*b* are opened.

Next, as shown in the right-end diagram in FIG. 12, the temporary storage plates 33*a* and 33*b* are closed.

As described above, the opening and closing of the temporary storage plates 33*a* and 33*b* shake and drop the banknotes attached to the temporary storage plates 33*a* and 33*b* by static electricity and the like, into the storage bag 21. The number of opening and closing times and timing of the temporary storage plates 33*a* and 33*b* are not limited to those in the example shown in FIG. 12.

Figure 13:
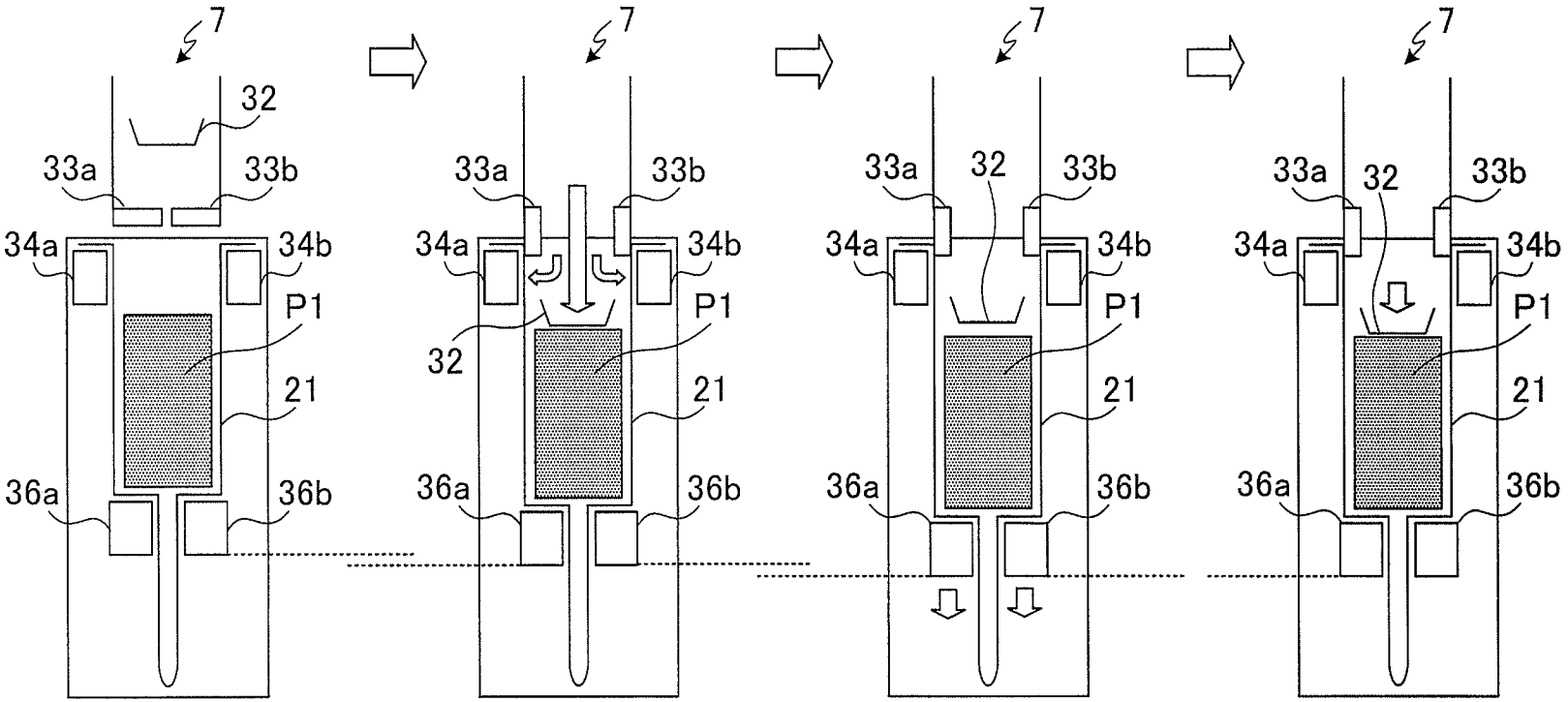
FIG. 13 illustrates detailed operations of "stage down 2"

FIG. 13 illustrates the detailed operations of the "stage down 2". In FIG. 13, the elements identical to those in FIG. 6 are assigned the same symbols. The left-end diagram in FIG. 13 shows the final state of the storing unit 7 in the "attached banknote dropping" shown in FIG. 12 (the storing unit 7 in the right-end diagram in FIG. 12).

First, in the "stage down 2", as shown in the second diagram from the left end in FIG. 13, the temporary storage plates 33*a* and 33*b* are opened. The pusher 32 is then lowered, and the banknotes P1 are pressed by the pusher 32. This process is performed to compress the banknotes P1 stacked in the vertical direction in order to prevent the banknotes P1 from collapsing when the stages 36*a* and 36*b* are moved in the downward direction.

Next, as shown in the third diagram from the left end in FIG. 13, the stages 36*a* and 36*b* are lowered by a lowering amount that is smaller than the final lowering amount. At this time, the pusher 32 is not raised, with the position of the pusher 32 being maintained, and the stages 36*a* and 36*b* are lowered. For example, the position of the pusher 32 indicated in the second diagram from the left end in FIG. 13 is maintained. As shown in the third diagram from the left end in FIG. 13, the stages 36*a* and 36*b* are lowered.

As with the description with reference to FIG. 11, the lowering amount of the stages 36*a* and 36*b* is, for example, shorter than the length of a short side of the banknote P1. Accordingly, the banknotes at the uppermost part of the banknotes P1 stored in the storage bag 21 are suppressed from being rotated. The banknotes stacked in the vertical direction are suppressed from collapsing.

Next, as shown in the right-end diagram in FIG. 13, the pusher 32 is lowered, and the banknotes P1 are pressed by the pusher 32. This process is performed in order to compress the gaps between the banknotes having been widened by the downward movement of the stages 36*a* and 36*b* and to prevent the banknotes from collapsing when the stages 36*a* and 36*b* are subsequently moved in the downward direction.

Figure 14:
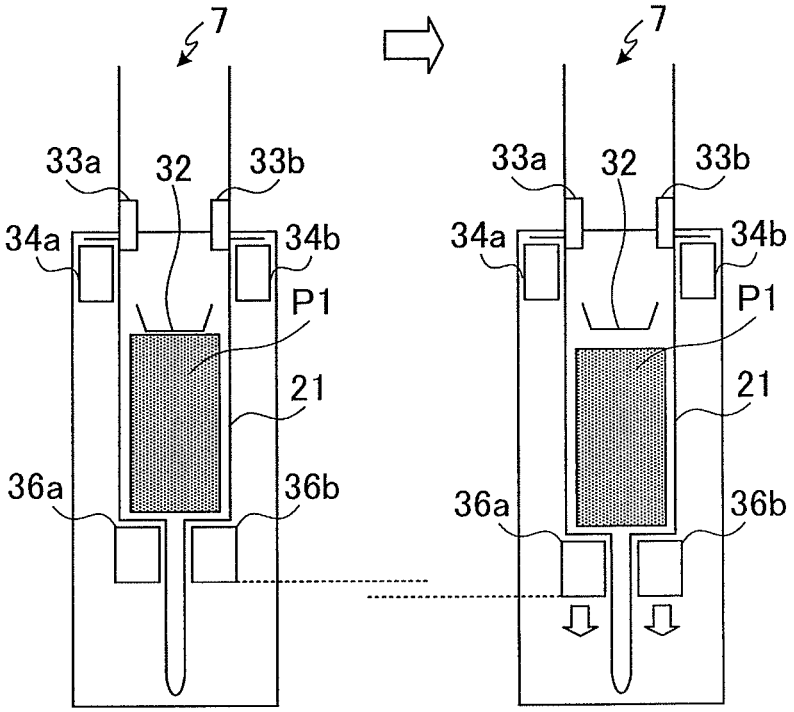
FIG. 14 illustrates detailed operations of "stage down 3"

FIG. 14 illustrates the detailed operations of the "stage down 3". In FIG. 14, the elements identical to those in FIG. 6 are assigned the same symbols. The left side diagram in FIG. 14 shows the final state of the storing unit 7 in the "stage down 2" shown in FIG. 13 (the storing unit 7 in the right-end diagram in FIG. 13).

In "stage down 3", as shown in a right side diagram of FIG. 14, the stages 36*a* and 36*b* are lowered by a lowering amount that is smaller than the final lowering amount. At this time, the pusher 32 is not raised, with the position of the pusher 32 being maintained, and the stages 36*a* and 36*b* are lowered.

As with the description with reference to FIG. 11, the lowering amount of the stages 36*a* and 36*b* is, for example, shorter than the length of a short side of the banknote P1. Accordingly, the banknotes at the uppermost part of the banknotes P1 stored in the storage bag 21 are suppressed from being rotated. The banknotes stacked in the vertical direction are suppressed from collapsing.

As shown in FIGS. 11, 13 and 14, the control section 10 performs operation control so as to move the stages 36*a* and 36*b* and the pusher 32 only in the downward direction, in the "stage down 1", "stage down 2" and "stage down 3". That is, in the "stage down 1", "stage down 2" and "stage down 3", the control section 10 does not perform the operation control of raising the pusher 32. Accordingly, the banknote storing apparatus 1 can suppress the time for sealing the storage bag 21 from increasing.

Figure 15:
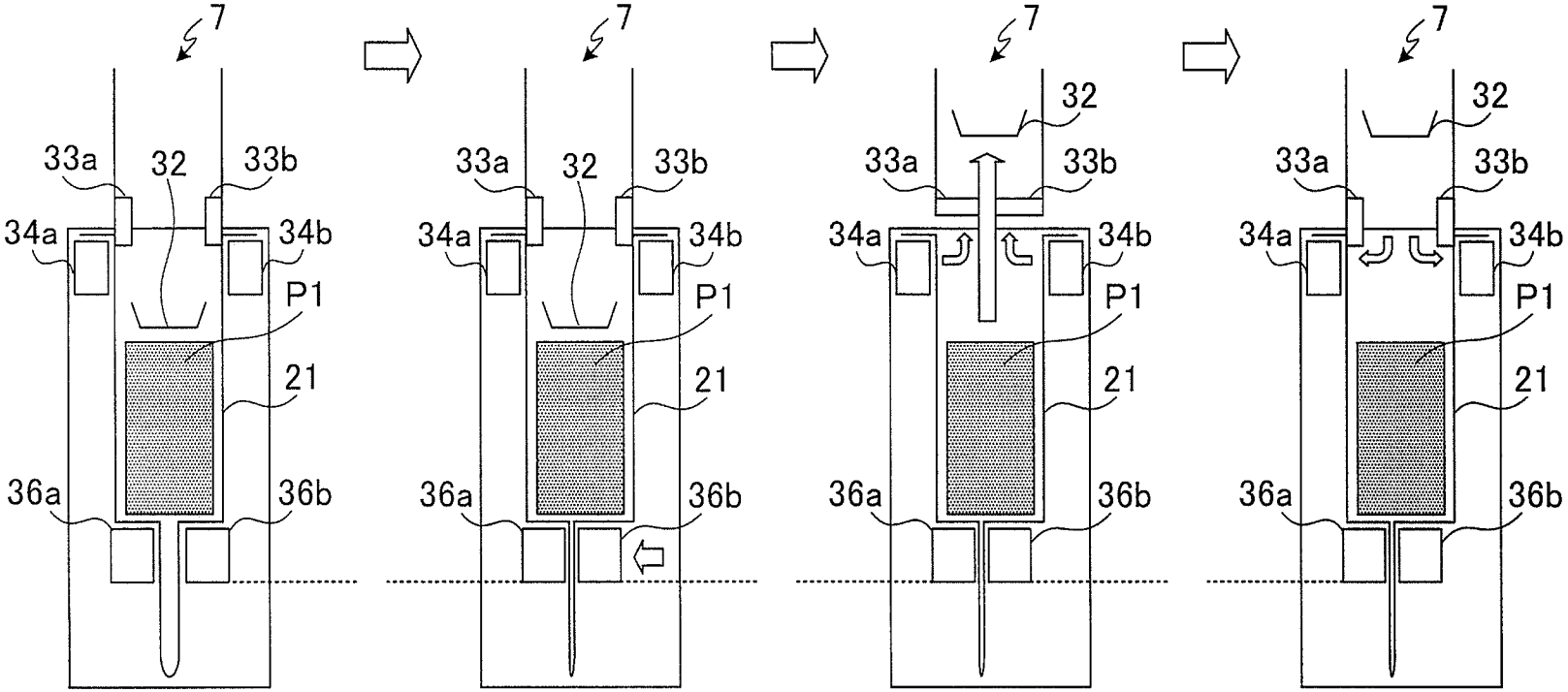
FIG. 15 illustrates detailed operations of "banknote pressing"

FIG. 15 illustrates detailed operations of "banknote pressing". In FIG. 15, the elements identical to those in FIG. 6 are assigned the same symbols. The left-end diagram in FIG. 15 shows the final state of the storing unit 7 in the "stage down 3" shown in FIG. 14 (the storing unit 7 in the right-end diagram in FIG. 14).

In the "banknote pressing", first, as shown in the second diagram from the left end in FIG. 15, the stage 36*b* is moved in the direction toward the stage 36*a*, and the gap between the stage 36*a* and the stage 36*b* are closed. The reason to close the gap between the stage 36*a* and the stage 36*b* is as follows.

In the next process that is "storage bag sealing", the control section 10 performs operation control so as to move the holding section 34*b* in the direction toward the holding section 34*a*. This control is to prevent the storage bag 21 from deforming and the banknotes P1 from falling between the stage 36*a* and the stage 36*b*, at this time. That is, according to the operation that narrows the gap between the stages 36*a* and 36*b* before narrowing the gap between the holding sections 34*a* and 34*b* (closing the holding sections 34*a* and 34*b*) and then narrows the gap between the holding sections 34*a* and 34*b*, thereby preventing the banknotes from falling between the stages 36*a* and 36*b*. The pressing by the pusher 32 prevents the banknotes from falling between the stages 36*a* and 36*b*.

Next, as shown in the third diagram from the left end in FIG. 15, the pusher 32 is moved to the uppermost part. The temporary storage plates 33*a* and 33*b* are then closed.

Next, as shown in the right-end diagram in FIG. 15, the temporary storage plates 33*a* and 33*b* are opened.

Figure 16:
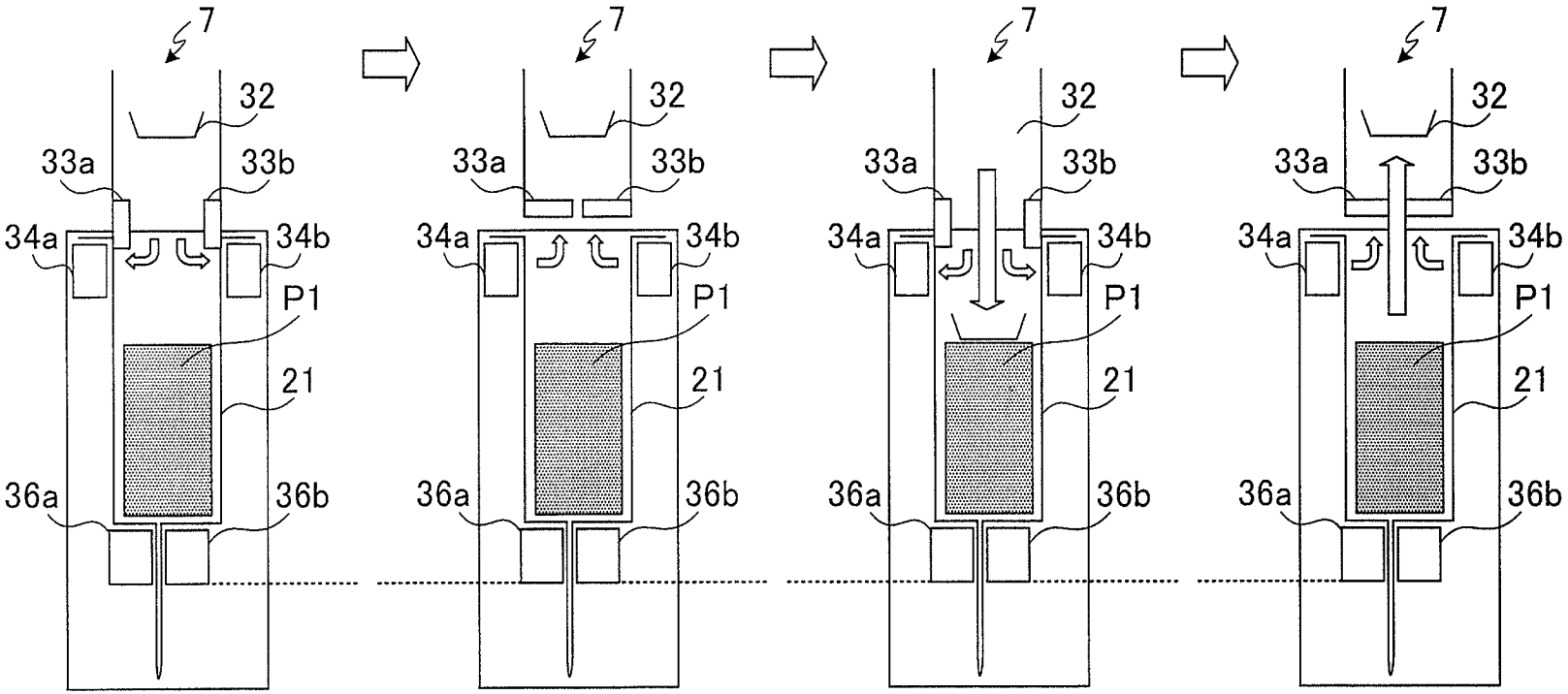
FIG. 16 illustrates operations continued from FIG. 15.

FIG. 16 illustrates operations subsequent to FIG. 15. In FIG. 16, the elements identical to those in FIG. 6 are assigned the same symbols. The left-end diagram in FIG. 16 shows the storing unit 7 (the storing unit 7 with the temporary storage plates 33*a* and 33*b* being opened) at the right end in FIG. 15.

After the temporary storage plates 33*a* and 33*b* are opened, the temporary storage plates 33*a* and 33*b* are closed as shown in the second diagram from the left end in FIG. 16. The opening and closing of the temporary storage plates 33*a* and 33*b* in this process and the process previous to this process are performed in order to shake and drop the banknotes attached to the temporary storage plates 33*a* and 33*b* owing to static electricity or the like, into the storage bag 21.

Next, as shown in the third diagram from the left end in FIG. 16, the temporary storage plates 33*a* and 33*b* are opened. The pusher 32 is then lowered, and the banknotes P1 are pressed by the pusher 32. This process is performed to compress the banknotes P1 stacked in the vertical direction in order to prevent the banknotes P1 from collapsing when the storage bag 21 is sealed.

Next, as shown in the right-end diagram in FIG. 16, the pusher 32 is moved upward to the uppermost part. The temporary storage plates 33*a* and 33*b* are then closed.

As shown in the right-end diagram in FIG. 16, after the temporary storage plates 33*a* and 33*b* are closed, the process transitions to the "storage bag sealing". In the "storage bag sealing", the holding section 34*b* is moved in the direction toward the holding section 34*a*, and the holding sections 34*a* and 34*b* are closed. The temperatures of the heating sections 35*a* and 35*b* included in the respective holding sections 34*a* and 34*b*, and the temperatures of the heating sections 37*a* and 37*b* included in the respective stages 36*a* and 36*b* are increased, thereby sealing the storage bag 21. Accordingly, the storage bag 21 is sealed at positions upper and lower than the stored banknotes P1, thus allowing the banknotes stored in the storage bag 21 to be enclosed.

As shown in the second diagram from the left end in FIG. 15, the gap between the stages 36*a* and 36*b* is closed. Consequently, when the temperatures of the heating sections 37*a* and 37*b* of the stages 36*a* and 36*b* increase, the portion of the storage bag 21 clamped by the stages 36*a* and 36*b* is sealed by heat-welding.

As described above, the banknote storing apparatus 1 includes: the stages 36*a* and 36*b* that support the banknotes from below via the storage bag 21; the stage drive section 74 that moves up and down the stages 36*a* and 36*b*; and the control section 10 that controls the stage drive section 74 on the basis of the amount of banknotes stored in the storage bag 21. Accordingly, even when the number of banknotes stored in the storage bag 21 is small, the banknote storing apparatus 1 can seal the storage bag 21, with the banknotes stacked in the vertical direction being prevented from collapsing. The banknote storing apparatus 1 can also prevent the banknotes from being stacked between the stages 36*a* and 36*b*, and suppress a sealing failure in the storage bag 21. If the number of banknotes stored in the storage bag 21 is large, the banknote storing apparatus 1 immediately lowers the stages 36*a* and 36*b* to the predetermined value. Accordingly, the banknote storing apparatus 1 can reduce the time for sealing the storage bag 21. This is also applicable to the storing unit 8.

In the above description, the number of temporary stops of the stages 36*a* and 36*b* is changed on the basis of the number of banknotes stored in the storage bag 21. However, the mode is not limited thereto. For example, the number of temporary stops of the stages 36*a* and 36*b* may be changed according to the weight of the banknotes stored in the storage bag 21.

For example, when the weight of the banknotes stored in the storage bag 21 is a predetermined value or higher, the control section 10 may set the number of temporary stops of the stages 36*a* and 36*b* to zero. When the weight of the banknotes stored in the storage bag 21 is less than the predetermined value, the control section 10 may set the number of temporary stops of the stages 36*a* and 36*b* to one or more. The control section 10 may change the number of temporary stops of the stages 36*a* and 36*b* on the basis of the value of a weight scale provided on the stages 36*a* and 36*b*. This section may count the number of banknotes stored in the storage bag 21, and calculate the weight of the banknotes stored in the storage bag 21, on the basis of the weight per banknote and of the number of banknotes stored in the storage bag 21.

In the above description, when the number of banknotes stored in the storage bag 21 is the predetermined number or larger, the control section 10 sets the number of temporary stops of the stages 36*a* and 36*b* to zero; when the number of banknotes stored in the storage bag 21 is less than the predetermined number, the control section 10 sets the number of temporary stops of the stages 36*a* and 36*h* to the predetermined number. The mode is not limited thereto. For example, in a case where the number of banknotes stored in the storage bag 21 is the predetermined number or more, the control section 10 may set the number of temporary stops to x; when the number of bank notes stored in the storage bag 21 is less than the predetermined number, the control section 10 may set the number of temporary stops to y (y>x). That is, in a case where the amount of banknotes stored in the storage bag 21 is less than the predetermined amount, the control section 10 may set the number of temporary stops of the stages 36*a* and 36*b* to a number more than that in a case where the amount of banknotes is the predetermined amount or more.

In the above description, the lowering amount from the temporary stop of the stages 36*a* and 36*b* to the next temporary stop is set to be shorter than the length of a short side of the banknote stored in the storage bag 21. However, the lowering amount is not limited thereto. The control section 10 may determine the lowering amount from the temporary stop of the stages 36*a* and 36*b* to the next temporary stop, on the basis of the type of banknotes. The control section 10 may lower the stages 36*a* and 36*b* by the predetermined value, while repeating movement by the determined lowering amount and temporary stop. The type of banknote may be the denomination of the banknote, the size of the banknote, a fit note, an unfit note or the like.

The control section 10 may accept an input of the lowering amount from the temporary stop of the stages 36*a* and 36*b* to the next temporary stop through the operation/display section 9, and move the stages 36*a* and 36*b* by the predetermined value while repeating the movement by the accepted lowering amount and temporary stop. Accordingly, the banknote storing apparatus 1 can flexibly change the lowering amount of the stages 36*a* and 36*b*.

In the case where the amount of banknotes stored in the storage bag 21 is less than the predetermined amount, the control section 10 may reduce the movement speed of the stages 36*a* and 36*b* to be a speed less than that in the case where the amount of banknotes is the predetermined amount or more. Accordingly, even when the number of banknotes stored in the storage bag 21 is small, the banknote storing apparatus 1 can seal the storage bag 21, with the banknotes being further prevented from collapsing.

In the above description, the control section 10 moves the stages 36*a* and 36*b* and the pusher 32 alternately in downward direction. However, the movement is not limited thereto. For example, if the amount of banknotes stored in the storage bag 21 is less than the predetermined amount, the control section 10 may move the stages 36*a* and 36*b* in the downward direction, with the banknotes being clamped after the banknotes may be clamped by the pusher 32 and the stages 36*a* and 36*b*. Accordingly, when the stages 36*a* and 36*b* are moved in the downward direction, the banknote storing apparatus 1 can further prevent the banknotes stacked in the vertical direction from collapsing.

The control section 10 may vibrate the stages 36*a* and 36*b*. For example, the control section 10 temporarily stops the stages 36*a* and 36*b*, and subsequently moves up and down the stages 36*a* and 36*b* at least once to vibrate these stages. Accordingly, for example, the banknote storing apparatus 1 can correct the banknotes, which have been obliquely inclined when the stages 36*a* and 36*b* are lowered, so that the print surfaces will be oriented in the vertical direction.

The control section 10 may accept an input of the amount of banknotes, which is the number of banknotes or the weight of the banknotes, through the operation/display section 9. The control section 10 may change the number of temporary stops of the stages 36*a* and 36*b* on the basis of the accepted amount of banknotes.

In a case where the number of temporary stops is changed according to the weight of the banknotes, the control section 10 may change the parameter of the weight of the banknotes according to the denomination of the banknotes and then calculate the weight of the banknotes stored in the storage bag 21. For example, the control section 10 sets a certain value "$W_x$" to "1", sets the ratio of the weight of a denomination A to "$W_x$" to be "$P_A$ ($P_A$<1)", sets the ratio of the weight of a denomination B to "$W_x$" to be "$P_B$ ($P_B$<1)", and sets the ratio of the weight of a denomination C to "$W_x$" to be "$P_C$ ($P_C$<1)". It is assumed that the storage bag 21 stores x banknotes of denomination A, y banknotes of denomination B, and z banknotes of denomination C. In this case, the control section 10 can calculate the weight "W" of the banknotes in the storage bag 21 according to the following expression (1).

$$W=W_X(x\cdot P_A+y\cdot P_B+z\cdot P_C) \quad (1)$$

In the above description, the control section 10 provides one determination condition of the number of temporary stops of the stages 36*a* and 36*b*. However, the condition(s) is not limited thereto. For example, the control section 10 may have two or more determination conditions of changing the number of temporary stops. For example, now define the number of banknotes for which the number of temporary stops is changed as "a", "b" (a>b). If the number of banknotes stored in the storage bag 21 is "a" or more, the control section 10 sets the number of temporary stops of the stages 36*a* and 36*b* to zero. If the number of banknotes stored in the storage bag 21 is less than "a" and "b" or more, the control section 10 sets the number of temporary stops of the stages 36*a* and 36*b* to *x*. If the number of banknotes stored in the storage bag 21 is less than "b", the control section 10 may set the number of temporary stops of the stages 36*a* and 36*b* to *y* (y>x).

Even in a case where the control section 10 lowers the stages 36*a* and 36*b* by the predetermined value without temporary stop (in a case of immediate descent), the holding sections 34*a* and 34*b* may be opened and closed in order to shake and drop the banknotes attached to the holding sections 34*a* and 34*b* owing to static electricity or the like, into the storage bag 21.

The control section 10 may omit both or any one of the banknote pressing processes that are "stage down 1" and "stage down 2" (for example, the process shown in the second diagram from the left end in FIG. 11, and the process shown in the second diagram from the left end in FIG. 13). The control section 10 may omit the process of the "attached banknote dropping".

The temporary stop of the stages 36*a* and 36*b* is also applicable to the processes before the storage bag 21 being sealed, for example, the deposit process and the like. For example, the control section 10 may lower the stages 36*a* and 36*b* when or after storing the deposited banknotes in the storage bag 21. In this case, the control section 10 may change the number of temporary stops of the stages 36*a* and 36*b* on the basis of the amount of banknotes stored in the storage bag 21.

It has thus been described that the stages 36*a* and 36*b* are lowered by the control section 10 by the predetermined value. Alternatively, these stages may be lowered to the predetermined position. For example, the control section 10 may lower the stages 36*a* and 36*b* to the predetermined position (final lowered position) while temporarily stopping these stages. That is, for the stages 36*a* and 36*b*, the final lowering amount may be defined or the final lowered position may be defined. The method of moving the stages 36*a* and 36*b* in the downward direction is not particularly limited.

Before the control section 10 closes the holding sections 34*a* and 34*b*, the control section 10 narrows the gap between the stages 36*a* and 36*b*. Alternatively, the control section 10 may narrow the gap between the stages 36*a* and 36*b* before the pusher 32 presses the banknotes. Accordingly, the banknote storing apparatus 1 can prevent the banknotes from falling between the stages 36*a* and 36*b*, by the pressing by the pusher 32.

REFERENCE SIGNS LIST

1 Banknote storing apparatus
2 inlet section
3 Transport system
4 Recognition unit
5 Storing and feeding unit
6 Dispensing section
7, 8 Storing unit
9 Operation/display section
10 Control section
21, 22 Storage bag
31 Feeding section
32 Pusher (pressing section)
33*a*, 33*b* Temporary storage plate
34*a*, 34*b* Holding section
35*a*, 35*b*, 37*a*, 37*b*, 85, 86 Heating section
36*a*, 36*b* Stage (support section)
41 Frame
42*aa* to 42*ac*, 42*ba* to 42*bc* Pin
43 Guide pin
44 Elongated hole
51*a*, 51*b* Attachment section
52*aa* to 52*ac*, 52*ba* to 52*bc* Hole
61 Memory section
62 Communication interface section
71, 81 Pusher drive section (pressing drive section)
72, 82 Temporary storage plate drive section
73, 83 Holding section drive section
74, 84 Stage drive section (drive section)
P1 Banknotes

The invention claimed is:

1. A sheet storing apparatus for storing sheets into a storage bag having an opening, the sheet storing apparatus comprising:

an inlet through which sheets are taken in from outside of the apparatus into the apparatus;

a transport unit configured to transport the sheets taken into the apparatus through the inlet;

a storing unit which is connected to the transport unit and configured to mount the storage bag in the storing unit, and store, in the mounted storage bag, the sheets transported by the transport unit;

a counter which is disposed at the transport unit and configured to count a number of the transported sheets to be stored in the storage bag mounted in the storing unit;

a holding member which is disposed in the storing unit and configured to hold an upper part, near the opening, of the storage bag mounted in the storing unit;

a first heater which is configured to heat seal a lower part of the storage bag held by the holding member;

a stage which is disposed below the holding member in the storing unit, the stage being provided with the first heater and configured to support the sheets stored in the storage bag from below via the storage bag and to move up and down between a first position and a second position, the first position being a position where the stage is located when the storing unit completes storing the transported sheets in the storage bag, the second position being a position below the first position and where the stage is located when the first heater heat seals the lower part of the storage bag storing the sheets therein;

a controller configured to control the sheet storing apparatus, wherein when the controller determines that the number of counted sheets is less than a predetermined number, the controller stops moving the stage at one or more times after the stage starts moving down from the first position and before the stage reaches the second position, and wherein when the controller determines that the number of the counted sheets is the predetermined number or more, the controller moves the stage down from the first position to the second position without stopping the moving of the stage.

2. The sheet storing apparatus according to claim 1, wherein the controller is configured to, in a case where the number of the counted sheets is less than the predetermined number, stop moving the stage a greater number of times than a number of times in a case where the number of the counted sheets is the predetermined number or more.

3. The sheet storing apparatus according to claim 1, wherein when the number of the counted sheets is less than the predetermined number, the controller is configured to reduce a movement speed of the stage compared to a case where the number of the counted sheets is the predetermined number or more.

4. The sheet storing apparatus according to claim 1, further comprising:

a pusher disposed in the storing unit, the pusher configured to move up and down and configured to press the sheets stored in the storage bag, wherein the controller controls the movement of the pusher, based on the number of the counted sheets.

5. The sheet storing apparatus according to claim 4, wherein when the number of the counted sheets is less than the predetermined number, the controller controls the sheet storing apparatus such that the pusher and the stage clamp the sheets stored in the storage bag and the stage moves down while the sheets are clamped by the pusher and the stage.

6. The sheet storing apparatus according to claim 4, wherein the controller is configured to control the sheet storing apparatus such that the stage and the pusher move down alternately.

7. The sheet storing apparatus according to claim 4, wherein the holding member includes a first holding member and a second holding member, the first and the second holding members being configured to hold the upper part of the storage bag, the stage includes a first stage and a second stage, the first and the second stages being configured to clamp the lower part of the storage bag held by the holding member, wherein the controller is configured to control the sheet storing apparatus such that the first and the second stages have a predetermined gap between the first and the second stages so as to be movable down, and narrow the gap before narrowing a gap between the first and the second holding members.

8. The sheet storing apparatus according to claim 1, wherein the holding member is provided with a second heater configured to heat seal the opening of the storage bag held by the holding member, and the controller is configured to control the sheet storing apparatus such that after the first heater heat seals the lower part of the storage bag storing the sheets therein, the second heater heat seals the opening of the storage bag storing the sheets therein.

9. The sheet storing apparatus according to claim 1, wherein the storing unit completes storing the sheets in the storage bag before the stage starts moving down from the first position, and the storing unit does not store the sheets in the storage bag after the stage starts moving down from the first position.

* * * * *